US009337570B2

(12) United States Patent
Inagaki et al.

(10) Patent No.: US 9,337,570 B2
(45) Date of Patent: May 10, 2016

(54) FEMALE CONNECTOR

(71) Applicant: Panasonic Corporation, Kadoma-shi, Osaka (JP)

(72) Inventors: Noboru Inagaki, Mie (JP); Shinichi Nakamura, Mie (JP); Masahiko Kimura, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/164,615

(22) Filed: Jan. 27, 2014

(65) Prior Publication Data

US 2014/0295710 A1 Oct. 2, 2014

(30) Foreign Application Priority Data

Mar. 28, 2013 (JP) ..... 2013-069919

(51) Int. Cl.

| | |
|---|---|
| ***H01R 13/52*** | (2006.01) |
| ***H01R 13/436*** | (2006.01) |
| ***H01R 13/504*** | (2006.01) |
| ***H01R 13/58*** | (2006.01) |
| ***H01R 24/20*** | (2011.01) |
| ***H01R 43/00*** | (2006.01) |
| *H01R 13/533* | (2006.01) |

(52) U.S. Cl.

CPC ..... *H01R 13/5216* (2013.01); *H01R 13/4367* (2013.01); *H01R 13/504* (2013.01); *H01R 13/5812* (2013.01); *H01R 24/20* (2013.01); *H01R 43/005* (2013.01); *H01R 13/5205* (2013.01); *H01R 13/533* (2013.01)

(58) Field of Classification Search

CPC ..... H01R 13/5216; H01R 43/005; H01R 13/4367; H01R 24/20; H01R 13/5812; H01R 13/5205

See application file for complete search history.

(56) References Cited

U.S. PATENT DOCUMENTS

| | | | | | |
|---|---|---|---|---|---|
| 2,833,569 | A | * | 5/1958 | Budnick | 285/389 |
| 3,219,961 | A | * | 11/1965 | Bailey et al. | 439/354 |
| 3,624,591 | A | * | 11/1971 | Buberniak | 439/462 |
| 3,667,783 | A | * | 6/1972 | Sotolongo | 285/151.1 |
| 3,986,765 | A | | 10/1976 | Shaffer et al. | |
| 4,316,647 | A | * | 2/1982 | Bailey et al. | 439/354 |
| 4,361,375 | A | * | 11/1982 | Bailey et al. | 439/357 |
| 4,634,208 | A | | 1/1987 | Hall et al. | |
| 5,567,174 | A | * | 10/1996 | Ericson et al. | 439/462 |
| 2006/0133201 | A1 | | 6/2006 | Chamberlain et al. | |

FOREIGN PATENT DOCUMENTS

JP 2012-146602 A 2/2012

OTHER PUBLICATIONS

European Search Report issued for the corresponding European patent application No. 14152219.3.

* cited by examiner

*Primary Examiner* — Briggitte R Hammond
(74) *Attorney, Agent, or Firm* — Mots Law, PLLC

(57) ABSTRACT

A female connector 1 includes a plurality of contactors 3, a holding body 5, a body 61, and a holder 62. Plurality of contactors 3 are connected to a plurality of electric wires 20 of a cable 2, respectively. Holding body 5 is designed to hold the plurality of contactors 3. Body 61 has a housing recess 610 designed to house the plurality of contactors 3 and holding body 5. Holder 62 is designed to prevent holding body 5 from falling from housing recess 610 by coupling to body 61. Female connector 1 includes a cover 63 formed by double molding so as to cover holder 62 in a state where cable 2 is inserted into holder 62 and where holder 62 and body 61 are coupled to each other. Holder 62 is designed to be in close contact with cable 2 along a whole circumference thereof.

1 Claim, 3 Drawing Sheets

FEMALE CONNECTOR

BACKGROUND OF THE INVENTION

1. Field of the Invention

The invention relates generally to female connectors, and more specifically to a female connector formed by double molding.

2. Description of the Related Art

In the past, there has been known a technique of so-called double molding, in which a first resin molded product is insert-molded to a second resin molded product (for example, see Japanese Patent Application Publication No. 2012-146602A).

There has been a female connector, which is installed at an end of a cable in which a plurality of electric wires are bundled. The female connector includes a plurality of contactors, a body and a holder. The plurality of contactors are connected to the plurality of electric wires, respectively. The body is designed to house the plurality of contactors. The holder is formed in an annular shape in which the cable is inserted, and designed to prevent the plurality of contactors from falling by coupling to the body.

Moreover, a male connector to which the female connector is connected includes a plurality of plug blades corresponding to the plurality of contactors, respectively. The body includes a plug blade insertion port for each contactor, to which a plug blade is inserted. Each of the plurality of contactors is configured to conduct the electricity to the plug blade which is inserted from the corresponding plug blade insertion port.

Further, in the female connector as described above, there has been a female connector including a cover formed by double molding so as to cover the holder in a state where the cable is inserted into the holder and where the holder is coupled to the body. The cover is designed to prevent water from entering from a gap between the body and the holder, or a gap between the holder and the cable.

In the female connector as described above, if resin which forms the cover enters around a contactor from the gap between the holder and the cable at the time of producing the cover in manufacturing the female connector, there may cause a problem of poor connection such that the electrical conduction between the contactor and the plug blade is inhibited by the resin which covers the contactor.

SUMMARY OF THE INVENTION

Hence, it is an object of the present invention to provide a female connector which can prevent poor connection.

A female connector of the present invention is installed at an end of a cable in which a plurality of electric wires are bundled, and includes: a plurality of contactors which are made of conductive material and connected to the plurality of electric wires, respectively; a holding body designed to hold the plurality of contactors; a body having a housing recess designed to house the plurality of contactors and the holding body; a holder formed in an annular shape in which the cable is inserted and designed to prevent the holding body from falling from the housing recess by coupling to the body; and a cover formed by double molding so as to cover the holder in a state where the cable is inserted into the holder and where the holder and the body are coupled to each other. The holder is designed to be in close contact with the cable along a whole circumference thereof.

In this configuration, it is preferable that the holder includes an annular projection which is designed to project annularly toward the cable so as to be in close contact with the cable along the whole circumference thereof.

According to the present invention, with having the holder being in close contact with the cable along the whole circumference thereof, it is possible to prevent resin which forms the cover, from flowing into a housing recess from a gap between the cable and the holder at the time of producing the cover in manufacturing the female connector. Thereby, it is possible to prevent poor connection caused by the resin.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

The best mode for carrying out the present invention will be explained below, with reference to the drawings.

Figure 1:
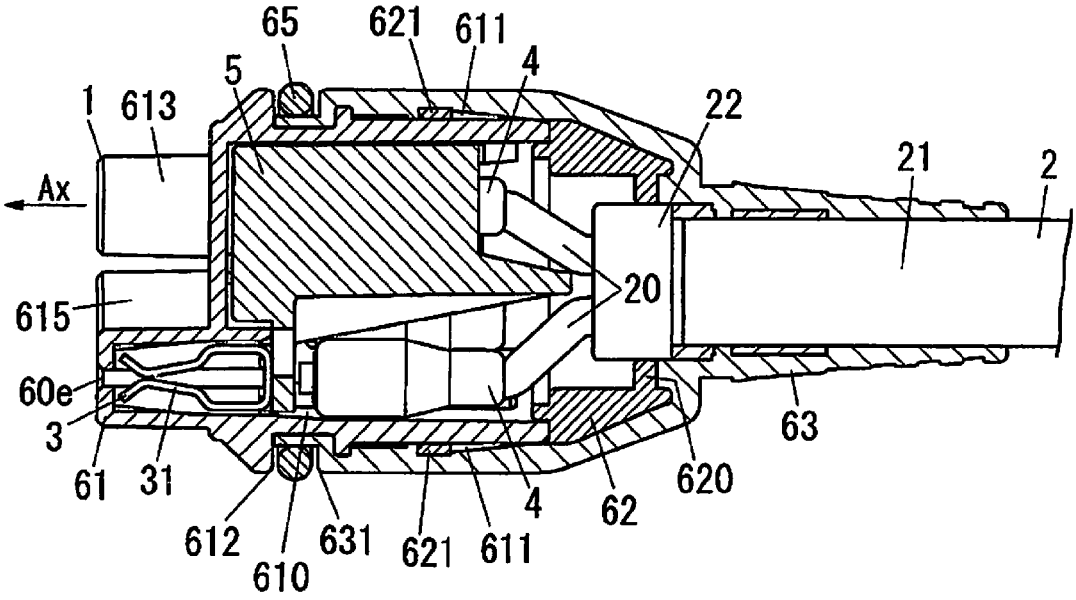
FIG. 1 is a sectional view showing the state in which a cap is removed, in a female connector according to an embodiment of the present invention.
Figure 2:
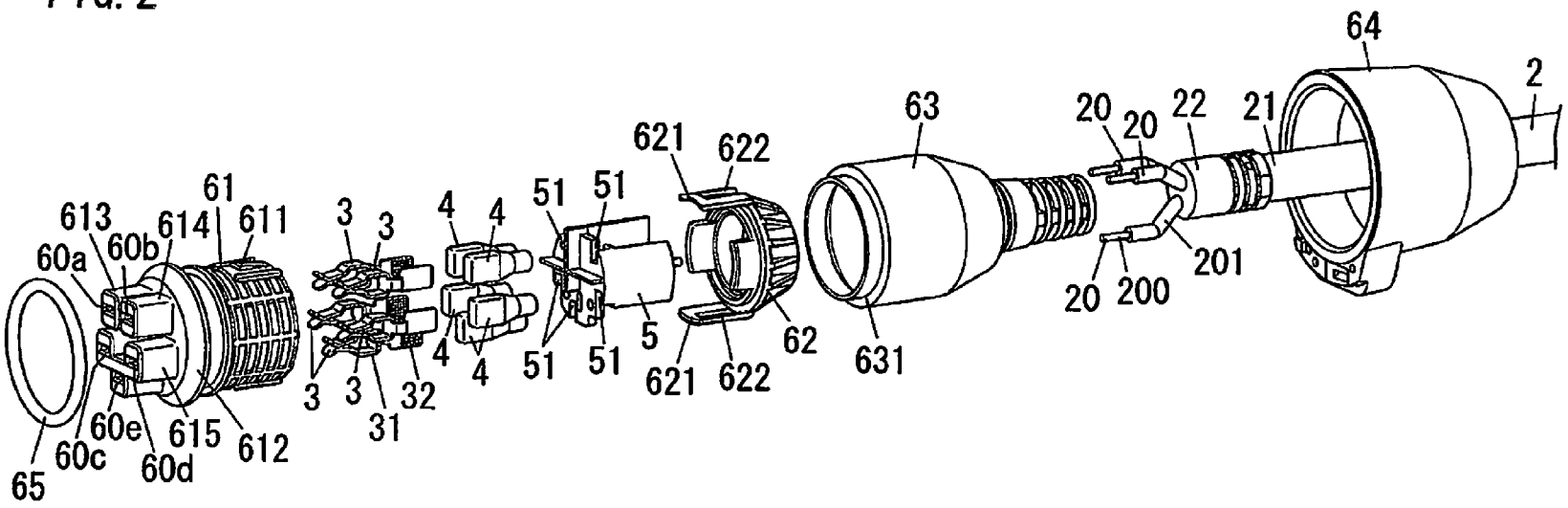
FIG. 2 is an exploded perspective view showing the female connector according to the embodiment of the present invention.

As shown in FIG. 1 and FIG. 2, a female connector 1 of the present embodiment is installed at an end of a cable 2. The cable 2 includes a plurality of electric wires 20 (three electric wires in an illustrated example) and a sheath 21 which bundles the plurality of electric wires 20. Each of the plurality of electric wires 20 includes a core wire 200 and a cover 201. The core wire 200 is made of conductive material such as copper. The cover 201 is made of insulating material such as synthetic resin, and designed to cover the core wire 200. The cable 2 is provided with a sealing part 22 which has a columnar shape and is designed to seal an end of the sheath 21. The sealing part 22 as described above is formed, for example, by filling synthetic resin into a cylindrical member in a state where the cylindrical member is attached to the end of the sheath 21.

Figure 3:
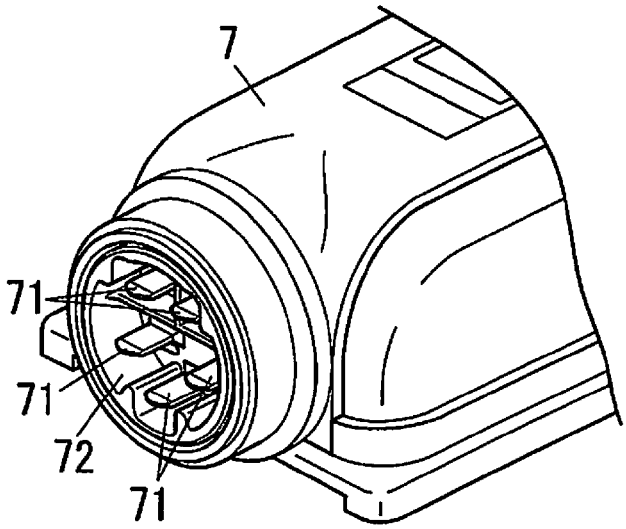
FIG. 3 is a perspective view showing a male connector to which the female connector according to the embodiment of the present invention is connected.

The female connector 1 includes a plurality of contactors 3 (five contactors in FIG. 1 and FIG. 2) which are made of conductive material such as metal. Three of the plurality of contactors 3 are connected electrically to the three electric wires 20, respectively (the remaining contactors 3 are auxiliary contactors and not used in the present embodiment). The plurality of contactors 3 are arranged so as to respectively correspond to a plurality of plug blades 71 (five plug blades in FIG. 3) included in a male connector 7 to which the female connector 1 is connected, as shown in FIG. 3. A direction in which the female connector 1 is connected to the male connector 7 is referred to as a connecting direction Ax (see FIG. 1) in the following description. Each of the plurality of contactors 3 includes a contact part 31 and a terminal part 32. The contact part 31 and the terminal part 32 are configured to conduct electrically to a corresponding plug blade 71 and the core wire 200 of a corresponding electric wire 20, respectively. That is, the plug blade 71 conducting electrically to the contact part 31 of the contactor 3, and the core wire 200 of the electric wire 20 conducting electrically to the terminal part 32 of the contactor 3 are electrically connected to each other via the contactor 3. Specifically, each of the plurality of plug blades 71 of the male connector 7 is made of metal plate and formed into a flat shape, and the contact part 31 is formed into a clip-like shape which is designed to hold the plug blade 71 elastically in a thickness direction (a direction orthogonal to the connecting direction Ax in FIG. 1). It is possible to produce the contactor 3 as described above by punching and bending metal plate, for example.

The female connector 1 further includes a heat shrinkable tube 4 which has a tubular shape, for each contactor 3. The heat shrinkable tube 4 is shrunk by being heated in a state where the terminal part 32 of the contactor 3 and the electric wire 20 are inserted into the heat shrinkable tube 4, thereby keeping constant contact of the terminal part 32 of the contactor 3 and the core wire 200 of the electric wire 20 by shrinking.

The female connector 1 further includes a holding body 5 which is made of synthetic resin for example, and designed to hold the plurality of contactors 3. Five contactors 3 are held by the holding body 5 by being fitted into five grooves 51 (see FIG. 2), respectively, which are designed at the holding body 5.

The female connector 1 further includes a body 61 which is made of synthetic resin and has a housing recess 610 designed to house the plurality of contactors 3, the plurality of heat shrinkable tubes 4 and the holding body 5. The body 61 is provided at an opposite side of an opening of the housing recess 610 (a front end side of the female connector 1, and also a left side in FIG. 1) with a first projection part 613, a second projection part 614, and a third projection part 615 which are designed to project along the connecting direction Ax. The first projection part 613 and the second projection part 614 are arranged in the left and right direction, when viewed the body 61 from the connecting direction Ax. The third projection part 615 is arranged at a lower side of the first projection part 613 and the second projection part 614, when viewed the body 61 from the connecting direction Ax. The first projection part 613 and the second projection part 614 have plug blade insertion ports 60*a* and 60*b* respectively, which are open toward the connecting direction Ax. The third projection part 615 has three plug blade insertion ports 60*c*, 60*d* and 60*e* which are open toward the connecting direction Ax. The plug blade insertion ports 60*a* to 60*e* are formed so as to correspond to the five plug blades 71 of the male connector 7 respectively, when the female connector 1 is connected to the male connector 7. The plug blade insertion ports 60*a* to 60*e* are designed to communicate with the housing recess 610, and every plug blades 71 are inserted into the plug blade insertion ports 60*a* to 60*e* respectively, so that a thickness direction of the plurality of plug blades 71 is parallel to the upward and downward direction in FIG. 1, when the female connector 1 is connected to the male connector 7. The plug blade insertion ports 60*a* to 60*e* correspond to the plurality of contactors 3, respectively, and the contact parts 31 of the plurality of contactor 3 elastically hold the plurality of plug blades 71 which are respectively inserted from the corresponding plug blade insertion ports 60*a* to 60*e*, from both sides of the thickness direction of the plurality of plug blades 71.

The female connector 1 further includes a holder 62 which is made of synthetic resin and designed to prevent the holding body 5 and the like from falling from the housing recess 610 by coupling with the body 61. The holder 62 is formed in an annular shape so as to allow the cable 2 to be inserted therein. The holder 62 includes two coupling pieces 621 which are designed to hold the body 61 from a rear side of the opening of the housing recess 610 of the body 61. Two coupling pieces 621 are designed to project along the connecting direction Ax from an upper end part and a lower end part of the holder 62 respectively, when viewed from the connecting direction Ax. Each of the two coupling pieces 621 has a coupling hole 622. The body 61 is provided at two opposite positions of external peripheral surface thereof with two coupling projections 611 respectively, which are designed to project outwardly. When trying to couple the holder 62 to the body 61 from the rear side of the opening of the housing recess 610, a worker should adjust positions of the two coupling holes 622 to match positions of the two coupling projections 611 respectively, while elastically deforming each of the two coupling pieces 621 so as to increase a distance between front ends of the two coupling pieces 621. If the worker elastically restores each of the two coupling pieces 621 in this state, the holder 62 couples to the body 61 by engaging the two coupling projections 611 into the two coupling holes 622, respectively. In a state of coupling to the body 61, the holder 62 is in close contact with the body 61 along a whole circumference of the opening of the housing recess 610 (a right side opening in FIG. 1).

The female connector 1 further includes a cover 63 formed by double molding so as to cover the holder 62 in a state where the cable 2 is inserted into the holder 62 and where the body 61 and the holder 62 are coupled to each other.

The female connector 3 further includes a cap 64 formed in a tubular shape and designed to cover the cover 63, and an O-ring 65. The O-ring 65 is made of soft material such as elastomer for example, and formed in an annular shape to surround the cover 63. The O-ring 65 is designed to close a gap between an inner surface of a recess 72 of the male connector 7 to which the cover 63 is mated (see FIG. 3) and the cover 63, when the female connector 1 is connected to the male connector 7.

The cover 63 has a step part 631 along a whole circumference thereof at its front end in the connecting direction Ax. The step part 631 is formed so as to be recessed inwardly from the outer peripheral surface of the cover 63. The body 61 is provided at its outer peripheral surface with a projection 612 which is designed to project outward along a whole circumference of the body 61. The projection 612 is formed in an annular shape and designed to form a groove with the step part 631 of the cover 63. The O-ring 65 is designed to be interposed in the groove formed between the step part 631 and the projection 612.

Note that, the holder 62 of the present embodiment is provided at its inner peripheral surface with an annular projection 620 which is designed to project inwardly. The annular projection 620 is designed to be in close contact with the cable 2 (the sealing part 22 of the cable 2 to be exact) along a whole circumference thereof. That is, the holder 62 is designed to completely close a rear side opening of the housing recess 610 of the body 61 together with the cable 2 (an opening except the plug blade insertion ports 60*a* to 60*e*, namely an opening which is formed at opposite side of the connecting direction Ax in the body 61).

Figure 4:
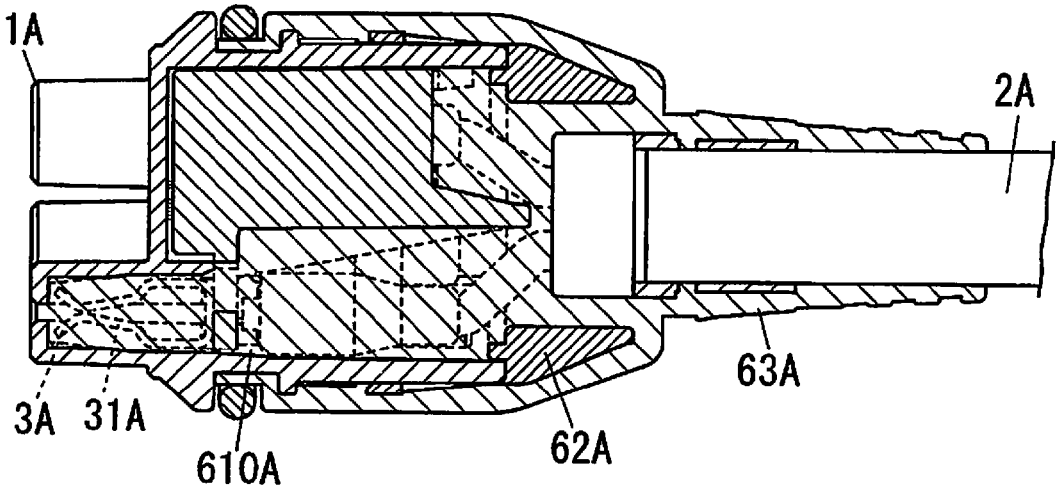
FIG. 4 PRIOR ART
FIG. 4 is a sectional view showing the state in which a cap is removed, in a comparative example which is compared to the female connector according to the embodiment of the present invention.

According to the structure mentioned above, with having the holder 62 being in close contact with the cable 2 along the whole circumference thereof, it is possible to prevent resin which forms the cover 63 from flowing into the housing recess 610 from a gap between the holder 62 and the cable 2 at the time of producing the cover 63 in manufacturing the female connector 1. If a holder 62A is not designed to be in close contact with a cable 2A like a female connector 1A of a comparative example shown in FIG. 4, resin which forms a cover 63A flows into a housing recess 610A at the time of producing the cover 63A and a contact part 31A of a contactor 3A may be covered by the resin. Thereby, it may cause a problem of poor connection such that the electrical conduction to the plug blade 71 is inhibited. On the other hand, the female connector 1 of the present embodiment can prevent poor connection which can be seen in the comparative example, due to the structure mentioned above.

The male connector 7 to which the female connector 1 according to the present embodiment is connected includes the plug blades 71 as blade-type plugs. Therefore, the plug blade insertion ports 60*a* to 60*e* of the female connector 1 according to the present embodiment are formed in an opening of narrow rectangular shape, and the contact part 31 of each contactor 3 is designed to be able to elastically hold the plug blade 71. However, the male connector 7 may have pin-type plugs. In this case, the female connector 1 includes insertion ports (not shown), each of which is opened in a circular shape, instead of the plug blade insertion ports 60*a* to 60*d*, and the contact part 31 of each contactor 3 is designed to be able to elastically hold pins (not shown) of male connector 7.

As described above, the female connector 1 of the present embodiment is installed at the end of the cable 2 in which a plurality of electric wires 20 are bundled. The female connector 1 includes: a plurality of contactors 3 which are made of conductive material and connected to the plurality of electric wires 20, respectively; the holding body 5 designed to hold the plurality of contactors 3; the body 61 having the housing recess 610 designed to house the plurality of contactors 3 and the holding body 5; the holder 62 formed in an annular shape in which the cable 2 is inserted and designed to prevent the holding body 5 from falling from the housing recess 610 by coupling to the body 61; and the cover 63 formed by double molding so as to cover the holder 62 in a state where the cable 2 is inserted into the holder 62 and where the holder 62 and the body 61 are coupled to each other. The holder 62 is designed to be in close contact with the cable 2 along the whole circumference thereof.

In the female connector 1 of the present embodiment, it is preferable that the holder 62 includes the annular projection 620 which is designed to project annularly toward the cable 2 so as to be in close contact with the cable 2 along the whole circumference thereof.

Although the present invention has been described with reference to certain preferred embodiments, numerous modifications and variations can be made by those skilled in the art without departing from the true spirit and scope of this invention, namely claims.

The invention claimed is:

1. A female connector with a cable for installation at an end of the cable, the cable comprising a plurality of electric wires bundled by a sheath, the cable being provided with a sealing part which has a columnar shape and is configured to seal an end of the sheath, the female connector with the cable comprising:

a plurality of contactors which are made of conductive material and connected to the plurality of electric wires, respectively;

a holding body designed to hold the plurality of contactors;

a body having a housing recess designed to house the plurality of contactors and the holding body;

a holder formed in an annular shape in which the cable is inserted and designed to prevent the holding body from falling from the housing recess by coupling to the body; and a cover formed by double molding so as to cover the holder in a state where the cable is inserted into the holder and where the holder and the body are coupled to each other, wherein the holder comprises an annular projection that projects inwardly toward the sealing part of the cable so as to be in contact with and seal the sealing part of the cable along a whole circumference of the cable, the annular projection having an inner peripheral surface, and wherein a whole circumference of the inner peripheral surface of the annular projection is shaped and dimensioned to be in contact with and seal an entire circumference of an outer peripheral surface of the sealing part of the cable such that resin material of the cover is blocked from flowing into the housing recess in manufacturing the female connector.

* * * * *